US010577671B2

(12) United States Patent
Suikkanen et al.

(10) Patent No.: US 10,577,671 B2
(45) Date of Patent: Mar. 3, 2020

(54) HIGH-HARDNESS HOT-ROLLED STEEL PRODUCT, AND A METHOD OF MANUFACTURING THE SAME

(71) Applicant: RAUTARUUKKI OYJ, Helsinki (FI)

(72) Inventors: Pasi Suikkanen, Oulu (FI); Mikko Hemmila, Vihanti (FI); Visa Lang, Oulu (FI); Iikka Miettunen, Oulu (FI); Olli Oja, Oulu (FI)

(73) Assignee: RAUTARUUKKI OYJ, Helsinki (FI)

( * ) Notice: Subject to any disclaimer, the term of this patent is extended or adjusted under 35 U.S.C. 154(b) by 345 days.

(21) Appl. No.: 14/915,116

(22) PCT Filed: Aug. 28, 2014

(86) PCT No.: PCT/EP2014/068274
§ 371 (c)(1),
(2) Date: Feb. 26, 2016

(87) PCT Pub. No.: WO2015/028557
PCT Pub. Date: Mar. 5, 2015

(65) Prior Publication Data

US 2016/0208352 A1 Jul. 21, 2016

(30) Foreign Application Priority Data

Aug. 30, 2013 (EP) ..... 13182449

(51) Int. Cl.
*C21D 1/18* (2006.01)
*C21D 6/00* (2006.01)
(Continued)

(52) U.S. Cl.
CPC ..... *C21D 1/18* (2013.01); *C21D 6/004* (2013.01); *C21D 6/005* (2013.01); *C21D 6/008* (2013.01);
(Continued)

(58) Field of Classification Search
None
See application file for complete search history.

(56) References Cited

U.S. PATENT DOCUMENTS 9,752,216 B2 * 9/2017 Kami ..... C21D 8/02
2006/0137780 A1 6/2006 Beguinot et al.
(Continued)

FOREIGN PATENT DOCUMENTS

CN 102199737 9/2011
EP 2589675 A1 5/2013
(Continued)

OTHER PUBLICATIONS

Machine-English translation of Japanese publication No. 2002-115024, Sadasue Teruki et al., Apr. 19, 2002.*
(Continued)

*Primary Examiner* — Colin W. Slifka
(74) *Attorney, Agent, or Firm* — Ballard Spahr LLP

(57) ABSTRACT

There is disclosed a method of manufacturing a hot-rolled steel product, such as a hot-rolled steel strip or plate product, wherein the microstructure of the steel product is martensitic, having Brinell hardness of at least 450 HBW. The method comprises the following steps in given sequence: a step of providing a steel slab containing, in terms of weight percentages, C: 0.25-0.45%, Si: 0.01-1.5%, Mn: 0.4-3.0%, Ni: 0.5-4.0%, Al: 0.01-1.2%, Cr: less than 2.0%, Mo: less than 1.0%, Cu: less than 1.5%, V: less than 0.5%, Nb: less than 0.2%, Ti: less than 0.2%, B: less than 0.01%, Ca: less than 0.01%, the balance being iron, residual contents and unavoidable impurities; a heating step of heating the steel slab to a temperature $T_{heat}$ in the range 950-1350° C.; a temperature equalizing step; a hot-rolling step in a temperature range of Ar3 to 1300° C. to obtain a hot-rolled steel material; and a step of direct quenching the hot-rolled steel material from the hot-rolling heat to a temperature of less
(Continued)

than Ms. The prior austenite grain structure of the obtained steel product is elongated in the rolling direction so that the aspect ratio is greater than or equal to 1.2.

19 Claims, 4 Drawing Sheets

(51) Int. Cl.

| | |
|---|---|
| ***C21D 8/02*** | (2006.01) |
| ***C21D 9/46*** | (2006.01) |
| ***C21D 9/52*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/54*** | (2006.01) |
| ***C22C 38/08*** | (2006.01) |

(52) U.S. Cl.

CPC ..... *C21D 8/02* (2013.01); *C21D 8/0205* (2013.01); *C21D 8/0226* (2013.01); *C21D 8/0247* (2013.01); *C21D 9/46* (2013.01); *C21D 9/52* (2013.01); *C22C 38/001* (2013.01); *C22C 38/002* (2013.01); *C22C 38/02* (2013.01); *C22C 38/04* (2013.01); *C22C 38/06* (2013.01); *C22C 38/08* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C21D 2211/008* (2013.01)

(56) References Cited

U.S. PATENT DOCUMENTS

| | | | | |
|---|---|---|---|---|
| 2006/0162826 | A1 | 7/2006 | Beguinot et al. | |
| 2013/0216422 | A1* | 8/2013 | Ueda ..... | C21D 8/02 420/83 |

FOREIGN PATENT DOCUMENTS

| | | | |
|---|---|---|---|
| EP | 2589676 | A1 | 5/2013 |
| EP | 2692890 | A1 | 2/2014 |
| EP | 2980256 | A1 | 2/2016 |
| EP | 2980257 | A1 | 2/2016 |
| JP | H08-041535 | A | 2/1996 |
| JP | H09 118950 | A | 5/1997 |
| JP | H11 71631 | A | 3/1999 |
| WO | 2003-083153 | A1 | 10/2003 |
| WO | WO-2014/154106 | A1 | 10/2014 |
| WO | WO-2014/154140 | A1 | 10/2014 |

OTHER PUBLICATIONS

Machine-English translation of JP08-041535, Okamura Yoshihiro et al., Feb. 13, 1996.*

European Search Report dated Feb. 24, 2014, from corresponding European Application No. 13182449.2 filed Aug. 30, 2013.

PCT International Search Report dated Sep. 30, 2014, from corresponding PCT Application No. PCT/EP2014/068274 filed Aug. 28, 2014.

PCT Written Opinion dated Sep. 30, 2014, from corresponding PCT Application No. PCT/EP2014/068274 filed Aug. 28, 2014.

* cited by examiner

HIGH-HARDNESS HOT-ROLLED STEEL PRODUCT, AND A METHOD OF MANUFACTURING THE SAME

FIELD OF THE INVENTION

The present invention relates to hot rolled steel products and methods of making hot rolled steel products.

BACKGROUND

High hardness is a material property that improves the performance of wear resistant and ballistic steels greatly. Wear resistant steels (also called as abrasion resistant steels) are used for instance in excavator or loader buckets of earth moving vehicles, in which super high hardness means longer service time of the vehicle component. By high hardness it is meant that the Brinell hardness is at least 450 HBW and especially in the range of 500-650 HBW.

Such hardness in steel product is typically obtained by martensitic microstructure produced by quench hardening steel alloy having high content of carbon (0.30-0.50 wt-%) after austenitization in the furnace. In this process steel plates are first hot-rolled, slowly cooled to room temperature from the hot-rolling heat, re-heated to austenitization temperature, equalized and finally quench hardened (hereinafter RHQ process). Because the relatively high content of carbon, which is required to achieve the desired hardness, the resulting martensite reaction causes significant internal residual stresses to the steel. This is because the higher the carbon content the higher the lattice distortion. This means that this type of steel is very brittle and can even crack during the quench hardening (quench induced cracking). To overcome these drawbacks related to brittleness, nickel is typically alloyed to such quench hardened steels. Also a tempering step after quench hardening is usually required, which however increases the processing efforts and costs. Examples of steels produced in this way are wear resistant steels disclosed in reference CN102199737 or some commercial wear resistant steels.

Reference JP 09-118950 A discloses a method for producing a hot-rolled wear resistant steel having a medium level of carbon (0.20 to 0.40 wt %) by the above-mentioned RHQ process, which includes slab heating, hot-rolling, cooling, re-heating to a temperature in the range $A_{c3}$-1250° C. and cooling with the cooling rate not less than 1.5° C./sec so that a martensitic microstructure may be obtained.

However, as commonly understood, the hardness of resulting martensite is solely dictated by carbon content. This means that in order to achieve the desired hardness, one needs certain amount of carbon in the steel, which in turn raises the risks for quench induced cracking and brittleness. Other drawback here is that carbon has the most debilitating effect on weldability of steel, as can be also seen from the following equation of carbon equivalent: CE=C+(Si+Mn)/6+(Cr+Mo+V)/5+(Ni+Cu)/15, in which lower CE means better weldability. For example loader buckets are manufactured by connecting the pieces of quench hardened steel plates by welding, good weldability of the quench hardened steel material is highly appreciated. Therefore there is a need to decrease the carbon content without compromising the hardness.

Also, for instance some of the earth moving vehicles operate at low-temperature use and some of the components of those undergo impact loads. For this reason their toughness, especially low-temperature toughness should be at a satisfying level in certain applications. Despite of relatively expensive nickel alloying, the toughness, especially in low-temperature, should be in certain applications further improved together with reasonable alloying costs to promote the use of super high hardness hot-rolled steels in more demanding applications. In this regard, boron alloying is commonly used practice to accomplish the hardenability of martensitic steels with low alloying costs. The boron alloying however requires use of titanium that can be harmful for low temperature toughness.

Further, as the vehicle components sometimes include shapes made by bending or flanging, the bendability of the steel shall preferably be excellent taking into account high hardness.

Also naturally the processing and alloying costs should be kept as low as possible.

References US 2006/0137780 A1 and US 2006/0162826 A1 disclose an alternative method of manufacturing a hot-rolled steel plate having abrasion resistance that is based on coarse Ti or Zr carbides formed at high temperature. However, the Ti or Zr carbides are detrimental for low temperature toughness. The great hardness of the steel and the presence of the embrittling Ti carbides make it necessary to slow down cooling before the temperature has fallen below $M_s$ temperature so that there is no risk for quench induced cracking.

In addition, reference WO 03/083153 A1 discloses a steel block for the production of injection moldings. To manufacture a mold with this steel, the steel is produced, is cast and hot-rolled or hot-forged in a known manner and cut to obtain blocks. The blocks are austenitized, optionally in the forging or rolling heat, and they are then quenched. The chemical composition of the steel block is optimized for high temperature application rather than low temperature application. Thermomechanically controlled processing (TMCP) in conjunction with direct quenching (DQ) or interrupted direct quenching (IDQ) is an effective process to produce low carbon, low alloyed ultra-high strength structural steels in yield strength range from 900 MPa up to 1100 MPa. The present invention extends the utilization of TMCP-DQ/IDQ process to produce high hardness hot-rolled steel products, such as strip and plate steels (450-600 HB) with high performance.

SUMMARY

Figure 1:
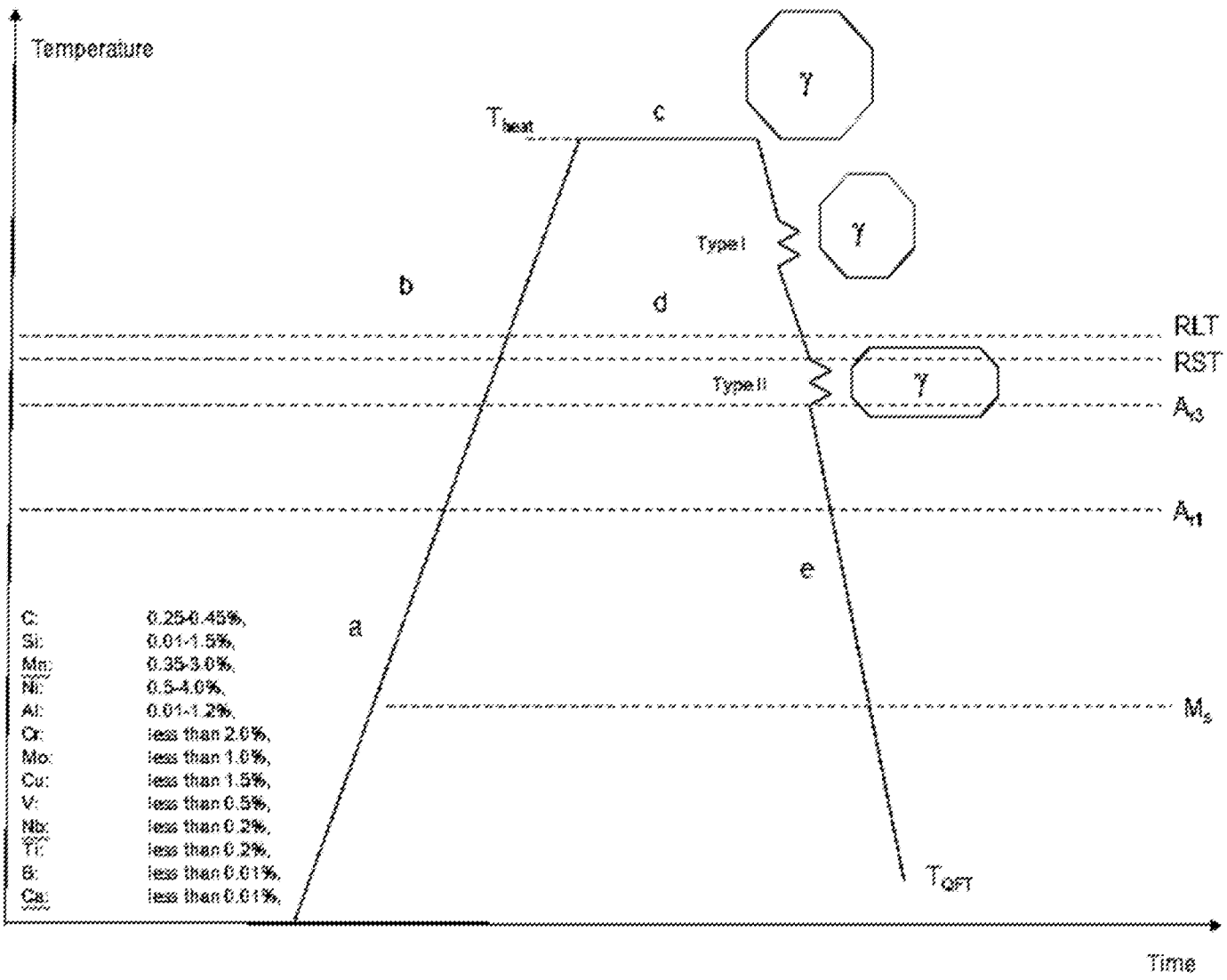
FIG. 1 shows schematically the manufacturing method according to one embodiment. Please note that FIG. 1 is not in scale.

In embodiments, there is provided a hot-rolled steel product having a prior austenite grain structure, the hot rolled steel product consisting of 0.25-0.45 wt % of carbon, 0.01-1.5 wt % of silicon, more than 0.35 wt % and no more than 3.0 wt % of manganese, 0.5-4.0 wt % of nickel, 0.01-1.2 wt % of aluminum, less than 2.0 wt % of chromium, less than 1.0 wt % of molybdenum, less than 1.5 wt % of copper, less than 0.5 wt % of vanadium, less than 0.2 wt % of niobium, less than 0.2 wt % of titanium, less than 0.01 wt % of boron, less than 0.01 wt % of calcium, with the balance being iron, residual contents, and unavoidable impurities;

wherein the microstructure of the steel product is martensitic, wherein the steel product has a Brinell hardness of at least 450 HBW, and wherein the prior austenite grain structure is elongated in a rolling direction so that the aspect ratio of the austenite grain structure is greater than or equal to 1.2.

DETAILED DESCRIPTION

The object of the present invention is to provide, with reduced risk for quench induced cracking, a high-hardness hot-rolled steel product, such as a hot-rolled steel strip or plate product, that holds improved weldability (due to the reduced carbon content) or alternatively higher hardness than typical wear resistant steels comprising an equal or higher content of carbon, and a method of manufacturing the same.

A further aim is to provide superior low temperature toughness properties without compromising high hardness of the hot-rolled steel product.

The object is obtained by a product according to claim 1 and a method according to claim 10. The dependent claims define further developments of the invention.

The steel alloy used for producing the high-hardness hot-rolled steel product is mainly characterized by a medium level of carbon C (0.25-0.45%) and a high level of nickel Ni (0.5-4.0%). Those two alloying elements are the most important alloying elements as explained more detailed later because first carbon provides basis for targeted high hardness and second because nickel is able to decrease risk for quench induced cracking. In other words, nickel enables the safe but also efficient production of this type of high-hardness hot-rolled steel product. Other alloying elements may vary depending on embodiments inside the given range.

Further, the present invention is based on modifications of austenite grains by hot-rolling immediately prior to direct quenching of hot-rolled steel material having given steel alloy. The hot-rolling of the austenite grains followed by direct quenching provides a prior austenite grain structure of the steel product which is elongated in the rolling direction so that the aspect ratio is greater than or equal to 1.2. This is in contrast to the above-mentioned RHQ process used in, for example, CN102199737 and JP 09-118950 A in which the steel is re-heated to austenitization temperature resulting in an equiaxial prior austenite grain structure having an aspect ratio of about 1.0.

In summary, the hot-rolled steel product according to the present invention has a Brinell hardness of at least 450 HBW and consists of the following chemical composition, in terms of weight percentages:

C: 0.25-0.45%,
Si: 0.01-1.5%,
Mn: more than 0.35% and equal to or less than 3.0%,
Ni: 0.5-4.0%,
Al: 0.01-1.2%,
Cr: less than 2.0%,
Mo: less than 1.0%,
Cu: less than 1.5%,
V: less than 0.5%,
Nb: less than 0.2%,
Ti: less than 0.2%,
B: less than 0.01%,
Ca: less than 0.01%, the balance being iron, residual contents and unavoidable impurities such as N, P, S, O and rare earth metals (REM), wherein the prior austenite grain structure of the steel product is elongated in the rolling direction so that the aspect ratio is greater than or equal to 1.2.

Several intensive experiments included in this description show that the hardness of the high hardness hot-rolled steel product tends to be the higher, the greater the aspect ratio of the prior austenite grain structure is. Therefore, the aspect ratio is preferably greater than 1.3, more preferably greater than 2.0. An aspect ratio greater than 1.3 or 2.0 can be achieved by a two-stage hot-rolling step as explained later.

It has been found that that the present invention provides possibility to lower the carbon content without compromising the hardness or alternatively to obtain higher hardness with equal or even smaller carbon content. Lowered carbon as such can decrease the risk for quench induced cracking due to the smaller lattice distortion. Also the present invention provides for improved weldability and properties related to low temperature toughness or alternatively, just simply for a higher hardness. In addition the present invention is able to provide excellent combination of hardness, low temperature toughness and bendability.

Next the chemical composition is described in more details: Carbon C content provides the basis for the chemical composition and is used in the range of 0.25-0.45% depending on targeted hardness. If the carbon content is less than 0.25%, it is difficult to achieve a Brinell hardness of more than 450 HBW in any tempered condition or more than 500 HBW in quenched condition. If the carbon content is more than 0.45%, weldability will suffer too much and direct quenching to a temperature lower than $M_s$ can cause quench induced cracks and/or impact toughness will suffer despite of nickel alloying. It is preferred that carbon content is more than or equal to 0.28%, because this way hardness of 550 HBW can be obtained in quenched condition. It is also preferred that carbon content is less than or equal to 0.40% or even less than or equal to 0.36% to ensure good weldability and impact toughness properties. Further the lower carbon content reduces the risk for quench induced cracking.

Silicon Si content is at least 0.01%, preferably at least 0.1% because Si is included in steels due to the smelt processing and Si increases the strength and hardness by increasing hardenability. Also it can stabilize residual austenite. However, silicon content of higher than 1.5% unnecessarily increases the CE thereby weakening the weldability. In addition, too high Si content can cause problems related to surface quality or in case of Type II hot-rolling. Therefore, Si is preferably not more than 1.0%, more preferably not more than 0.5% or even less.

Manganese Mn content is more than 0.35% and preferably 0.4% or more because Mn is advantageous alloying element to increase hardenability and it has slightly smaller effect on weldability than other alloying elements providing hardenability. If Mn is 0.35% or less, hardenability is not satisfying cost effectively. On the other hand, alloying Mn more than 3.0% unnecessarily increases the CE thereby weakening the weldability. For the same reason, preferably Mn is not more than 2.0% more preferably not more than 1.5%. The content of Mn depends on the content of other elements providing hardenability and therefore also relatively high contents can be allowed.

Nickel Ni is important alloying element for the steel according to the present invention and is used at least 0.5% primarily to avoid quench induced cracking and also to improve low temperature toughness. However nickel contents of above 4% would increase alloying costs too much without significant technical improvement. Therefore nickel content is less than 4%, preferably less than 3.0%, more preferably less than 2.5%. Preferably nickel used at least 1.0% and more preferably at least 1.5% to improve the low temperature toughness and to further avoid risk for quench induced cracking.

Aluminum Al is used at least as a deoxidation (killing) agent and the content of Al is in the range 0.01-1.2%. In addition Al can increase strength/hardness in some cases but also allows that ferrite may form to the microstructure before or during quenching, if desired. Also it can stabilize residual austenite. In case of Type II hot-rolling, consideration should be given to set Al to less than 1.0%. Most preferably, aluminum is used in the range 0.01-0.1%.

Chromium Cr content is less than 2.0% because it can be partially or completely replaced with other elements providing hardenability, for instance with Mn or Si, to obtain hardenability. However, preferably chromium is used (to avoid excessive use of Mn and Si) in the range of 0.1-1.5% or more preferably in the range 0.2-1%. Too high content of Cr increase CE unnecessarily and weakens the weldability.

Molybdenum Mo content is less than 1.0%, because hardenability is obtained more cost effectively with other alloying elements. However, preferably Mo is at least 0.1% because it improves low temperature toughness and tempering resistance, if needed. As molybdenum improves toughness, it is to be highly alloyed in this type of steel. Further, tempering resistance will be improved by Mo-alloying, if desired. The most preferred range of Mo is 0.1-0.8%.

Titanium Ti content is up to 0.2% or 0.1% because Ti can contribute to grain refining during hot-rolling. However, if excellent impact toughness properties are also desired, it is preferable to restrict titanium so that it is less than 0.02% or even better, less than 0.01%. This prevents coarse TiN particles from forming in the microstructure which can be detrimental for impact toughness properties as shown in the examples.

Boron B content is less than 0.01%. This means that B may be used to increase hardenability in contents of 0.0005-0.005%, for instance. However, as the hardenability is already good with other elements, it is not needed to alloy boron, i.e. B<0.0005% is preferable. In other words, the steel may be in essence boron-free. This enables that Ti content can be preferably lowered to be less than 0.02%, which is very beneficial for low temperature toughness. Effective boron alloying would require titanium content to be at least 3.4N to protect boron from boron nitrides.

Also a copper Cu content of less than 1.5%, a vanadium V content of less than 0.5% and a niobium Nb content of less than 0.2% can be included, but these alloying elements are not necessarily needed. Therefore, preferably their upper limits are as follows Cu<0.5%, V<0.1% and Nb<0.01%.

Calcium Ca content is less than 0.01%, based on possible Ca- or CaSi-treatment at smelt processing. Preferably, the calcium content is 0.0001-0.005%.

Residual contents include contents that may unavoidably exist is the steel, i.e. alloying elements having residual contents are not purposefully added. Example of residual content is copper content of 0.01% in composition A and B of Table 1.

Unavoidable impurities can be phosphor P, sulfur S, nitrogen N, hydrogen H, oxygen O and rare earth metals (REM) or the like. Their contents are preferably limited as follows in order to ensure excellent impact toughness properties:

Phosphor P<0.015%
Sulfur S<0.002%
Nitrogen N<0.006%
Hydrogen H<0.0002%
Oxygen O<0.005%
REM<0.1%.

The difference between residual contents and unavoidable impurities is that residual contents are controlled quantities of alloying elements, which are not considered to be impurities. A residual content as normally controlled by an industrial process does not have an essential effect upon the alloy.

The microstructure of the hot-rolled steel product is martensitic. This means that the microstructure may comprise, in terms of volume percentages, at least 90% martensite or alternatively martensite 60-95%, bainite 10-30%, retained austenite 0-10% and ferrite 0-5%. In other words, the main phase is martensite (M), as shown in Table 3. A high content of at least 90% martensite is preferred because this way a higher hardness is obtained.

The manufacturing method according the present invention comprises the following steps a) to e) in the given sequence:

a) a step of providing a steel slab consisting of the above mentioned chemical composition,
b) a heating step of heating the steel slab to a temperature $T_{heat}$ in the range 950-1350° C.,
c) a temperature equalizing step,
d) a hot-rolling step in a temperature range of $A_r3$ to 1300° C. to obtain a hot-rolled steel material, and
e) a step of direct quenching the hot-rolled steel material from the hot-rolling heat to a temperature of less than $M_s$ to obtain a hot-rolled steel product having a Brinell hardness of at least 450 HBW.

This manufacturing method can result in a hot-rolled steel product having a prior austenite grain structure that is elongated in the rolling direction so that the aspect ratio is greater than or equal to 1.2. In other words, the hot-rolled steel product is obtainable by the method according to the present invention.

The steel slab can be obtained by continuous casting, for instance. In the method according to the present invention, such steel slab is subjected to the heating step of heating the steel slab to a temperature $T_{heat}$ in the range 950-1350° C. and thereafter subjected to the temperature equalizing step. Equalizing step may take 30 to 150 minutes, for instance. These heating and equalizing steps provide temporarily a microstructure consisting of austenite and dissolve the alloying elements as well as precipitates. If the heating temperature is less than 950° C., dissolving is insufficient, and on the other hand use of temperatures greater than 1350° C. is uneconomical.

The equalized steel slab is subjected to a hot-rolling step in a temperature range of $A_r3$ to 1300° C. to obtain the hot-rolled steel material. This can results in that the hot-rolled steel product can have the prior austenite grain structure that is elongated in the rolling direction so that the aspect ratio is greater than or equal to 1.2. If the temperature is below $A_r3$, high hardness is not necessarily obtained because this way excessive amount of ferrite can form in the microstructure before the initiation of direct quenching step and further hot-rolling at two phase are can cause undesired microstructural banding.

After the hot-rolling step, the hot-rolled steel material is direct quenched from the hot-rolling heat to a temperature of less than $M_s$. This direct quenching step provides for essentially martensitic microstructure from the refined prior austenite grains structure which increases the hardness as shown later.

The benefit of direct quenching over a conventional RHQ process is that the alloying elements are greatly in solution before the quenching because higher heating temperatures can be used. This means that better hardenability and utilization of alloying elements is obtained. In the conventional RHQ process, the austenitizing temperature is usually below 950° C. to avoid coarsening of austenite grains. In present invention, the coarsened austenite grains are refined and optionally also elongated prior to direct quenching which means that higher austenitization temperatures can be used.

The hot-rolling step can comprise a Type I hot-rolling stage or Type I and Type II hot-rolling stages, as explained in the following.

According to a preferred embodiment, the method of manufacturing a hot-rolled steel product according to the present invention comprises a Type I hot-rolling stage of hot-rolling in the recrystallization temperature range. This means that Type I hot-rolling stage is carried out above the austenite recrystallization limit temperature RLT. An example of hot-rolling in the recrystallization temperature range is hot-rolling at a temperature in the range 950-1250° C. During hot-rolling of Type I, the coarse prior austenite grain structure is refined by static recrystallization. In addition, pores and voids that are formed in the steel slab during continuous casting are closed. In order to obtain such effect it is preferred that rolling reduction in hot-rolling Type I is at least 60%, preferably at least 70%. For example a 200 mm thick steel slab can be hot-rolled to a hot-rolled steel having thickness less than or equal to 80 mm, preferably less than or equal to 60 mm during hot-rolling of Type I.

According to a more preferred embodiment shown in FIG. 1, the method of manufacturing a hot-rolled steel product according to the present invention comprises, in addition to hot-rolling of Type I, also a Type II hot-rolling stage of hot-rolling in the no-recrystallization temperature range above the ferrite formation temperature $A_{r3}$. This means that Type II hot-rolling stage is carried out at a temperature below the austenite recrystallization stop temperature RST but above the ferrite formation temperature $A_{r3}$. An example of hot-rolling in the no-recrystallization temperature range is hot-rolling at a temperature in the range $A_{r3}$-950° C. or preferably $A_{r3}$-900° C., depending on chemical composition. During hot-rolling of Type II, the refined austenite grains are deformed in the non-recrystallization region of austenite to obtain fine elongated ("pancaked") austenite grains. This increases the interface of the prior austenite grains per unit volume and increases the number of deformation bands. This, in turn, enables further refinement of the microstructure, which is essential for obtaining good toughness after quenching. This also results in that the hot-rolled steel product can have the prior austenite grain structure that is elongated in the rolling direction so that the aspect ratio is greater than 1.3 or more preferably greater than 2.0. In order to obtain such effect it is preferred that rolling reduction in hot-rolling Type II is at least 50%, preferably at least 70%. An example of this is that a 80 mm thick hot-rolled steel is further hot-rolled to a hot-rolled steel having thickness less than or equal to 40 mm, preferably less than or equal to 24 mm, during hot-rolling of Type II.

After performing the hot-rolling step, direct quenching is initiated to transform the austenitic structure into a martensitic structure consisting essentially of martensite. If the quenching finishing temperature has been high (however below $M_s$), the martensitic microstructure can contain self-tempered regions. If the aluminum content has been high, the martensitic microstructure can contain ferrite less than 5%. The microstructure can also contain 10-30% of bainitic phases. Also less than 10% of residual austenite can exist, which can increase strain induced plasticity.

Fine elongate packs of martensite are obtained by transformation of the prior austenite grains into martensite packs. As a rule of thumb it can be said that the martensite packs are the finer the finer the prior austenite grains are.

Figure 2:
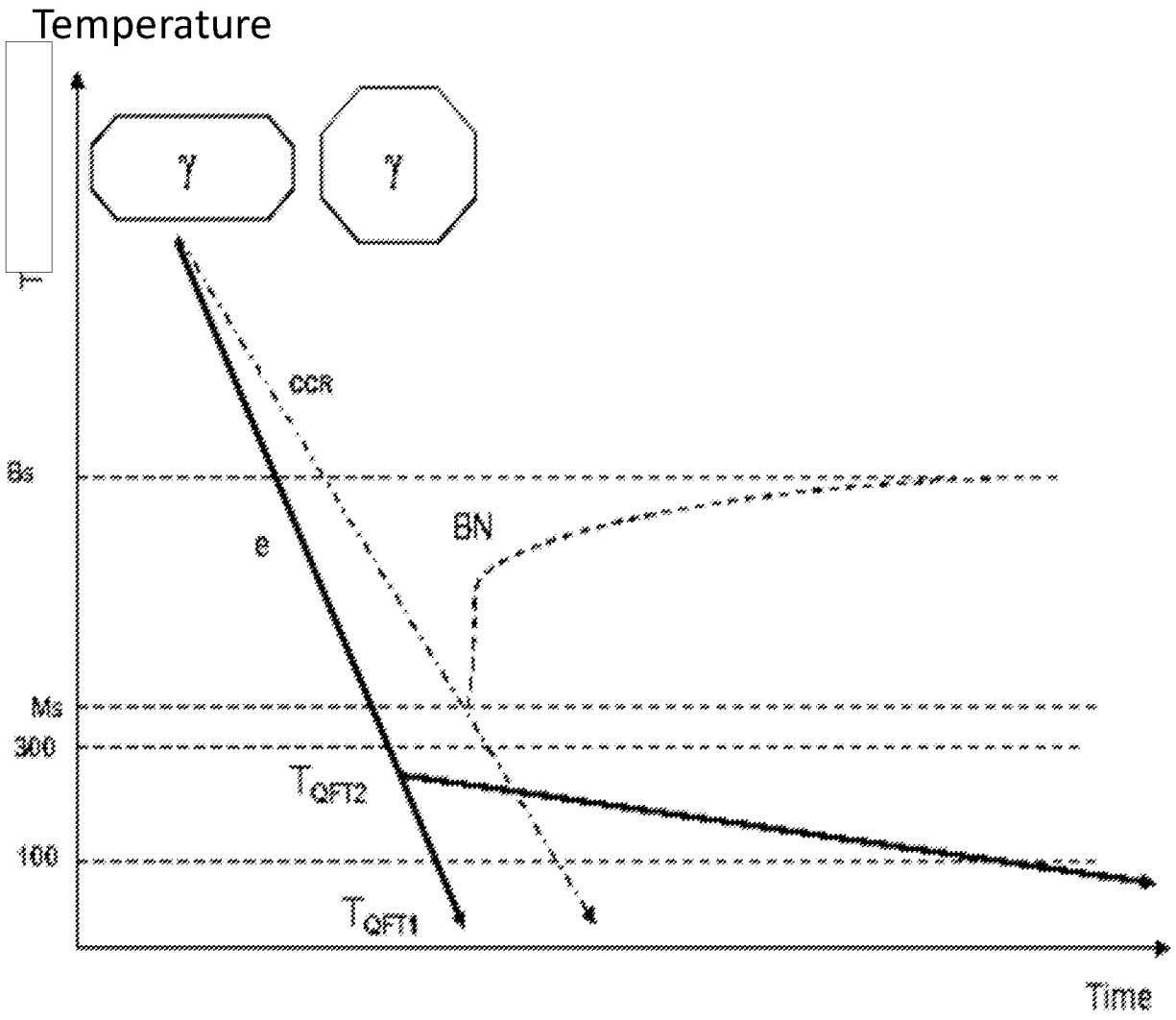
FIG. 2 shows schematically optional embodiments of direct quenching step. Please note that FIG. 1 is not in scale.

According to a first optional embodiment, shown in FIG. 2, the direct quenching step comprises quenching the hot-rolled steel from a temperature higher than $A_{r1}$, preferably from a temperature higher than $A_{r3}$, to a temperature $T_{QFT2}$ between $M_s$ and 100° C., such as between 300 and 100° C. by using an average cooling rate of at least 10° C./s, such as 10-200° C./s. This embodiment further enables that quench induced cracking is avoided, especially in the case of resulting hardness higher than 500 HBW. The cooling rate is at least 10° C./s, such as 10-200° C./s to avoid decomposition of austenite during quenching. Most preferably the cooling rate is higher than or equal to critical cooling rate (CCR), which can be defined by equations well available in the literature. If the quenching is started from a temperature higher than $A_{r3}$, the maximum amount of martensite can follow, which is advantageous for high hardness. If the quenching finishing temperature is higher than $M_s$ or 300° C., high hardness is not necessarily achieved because of a high degree of undesired microstructures such as self-tempered martensitic microstructures.

According to another optional embodiment, also shown in FIG. 2, the direct quenching step comprises quenching the hot-rolled steel from a temperature higher than $A_{r1}$, preferably from a temperature higher than $A_{r3}$, to a temperature $T_{QFT1}$ less than 100° C. by using an average cooling rate of at least 10° C./s, such as 10-200° C./s. Most preferably the cooling rate is higher than or equal to critical cooling rate (CCR), which can be defined by equations well available in the literature. This embodiment further enables the production of high strength hot-rolled steels in targeted hardness range of 450-500 HBW. The cooling rate is at least 10° C./s, such as 10-200° C./s to avoid decomposition of austenite during quenching. If the quenching is started from a temperature higher than $A_{r3}$, the maximum amount of martensite can follow, which is advantageous for high hardness.

Irrespective of how the direct quenching after hot-rolling is performed, the method can comprise after the direct quenching step a tempering step of tempering the hot-rolled steel product. However such a step is not necessarily needed because the invention is able to provide excellent impact toughness and other mechanical properties (taking into account the high-hardness) even without tempering. Therefore, as the properties can be already good at quenched condition, preferably the method does not comprise tempering. This means that the processing can be purely thermo-mechanical, without subsequent heat treatment.

The above described method can be carried out at plate rolling mill or more preferably at strip rolling mill. Similarly the high hardness product can be hot-rolled steel plate or hot-rolled steel strip, respectively.

The hot-rolled steel product may have a thickness Th in the range 2-80 mm. In particular, hot-rolled steel plates typically have a thickness Th in the range 8-80 mm, preferably 8-50 mm whereas hot-rolled steel strips have a thickness Th in the range 2-15 mm.

If the processing is carried out at strip rolling mill, the method additionally comprises a coiling step that is performed after direct quenching step.

The steel product is preferably a steel strip product because a strip rolling mill is capable to refine and elongate the prior austenite grain structure very effectively, thereby greatly emphasizing the effects of the present invention. Further as high hardness provides for excellent wearing and ballistic properties, even very low thicknesses in the range of 2-15 mm (even 2-6 mm) obtainable by strip rolling can be used, which means weight savings and also that new type of applications can be made of the steel product according to the present invention. In addition good flangeability obtainable by means of the present invention is further advantageous for new applications. Further smaller thicknesses reduce as such the risk for quench induced cracking.

BRIEF DESCRIPTION OF THE REFERENCE SIGNS AND TERMS

RST austenite recrystallization stop temperature

RLT austenite recrystallization limit temperature $T_{QFT}$ quenching finishing temperature $A_{c1}$ a temperature at which austenite begins to form during heating $A_{c3}$ a temperature at which transformation of ferrite to austenite is completed during heating $A_{r1}$ a temperature at which transformation of austenite to ferrite is completed during cooling $A_{r3}$ a temperature at which austenite begins to transform to ferrite during cooling CCR critical cooling rate (the slowest rate of cooling from the hardening temperature which will produce completely hardened martensitic microstructure)

$M_s$ a temperature at which martensite transformation can be started

Brinell hardness (HBW) in context of this patent disclosure is defined according to ISO 6506-1 on a surface milled 0.3-2 mm below strip or plate surface by using a ball made of hard metal (W) and having diameter of 10 mm and further by using a mass of 3000 kg (HBW 10/3000).

The grain size and aspect ratio of the prior austenite grain (PAG) structure is obtained according to the following procedure. First specimens are heat-treated at 350° C. for 45 min for etching of prior austenite grain boundaries. The specimens are then mounted and polished prior to etching. An etchant constituted of 1.4 g picric acid, 100 ml distilled water, 1 ml wetting agent (Agepol) and 0.75-1.0 ml of HCl is used to reveal prior austenite grain boundaries. Optical microscope is then used to examine the microstructure. Average prior-austenite grain size is calculated using line intercept method (ASTM E 112). Also aspect ratio of PAG is determined with the line intercept method from cross-section of the plate cut in the rolling direction. Intercepting grain boundaries are counted from lines with same length in rolling direction (RD) and in normal direction (NR). Aspect ratio is the average length in RD of the grains divided with the average height in NR, i.e. the sum of line intercepts in the normal divided with the sum of line intercepts in rolling direction.

The amount of retained austenite is determined with X-ray diffraction.

EXAMPLES

In the Examples, chemical compositions shown in Table 1 were used. Compositional values are given in terms of weight percentages. As can be seen, all these chemical compositions comprise C, Si, Mn, Al, Cr, Ni, Mo in addition to Fe, unavoidable impurities and residual contents. As can be also seen, all these chemical composition were in essence boron-free, i.e. they contained B: <0.0005%.

Compositions A,B, N and O were full scale smeltings including vacuum degassing and Ca-treatment. The main difference between composition A and B is that the composition B includes also Ti-alloying. Composition N and O comprised slightly higher carbon content than composition A and B.

Compositions C, D, E, F, G, H, I, J, K, L and M were cast to laboratory ingots so they did not include Ca-treatment. The main difference between compositions C and D is the carbon content which is lower in composition C. The main difference between composition D and E is that the composition E includes small Ti-alloying. Composition F is an example of composition including high (3.87%) Ni-alloying. Compositions G and H are example of compositions including also high (0.99% and 1.47%) Cu-alloying. Composition I further contains Ti-alloying. Composition J further shows a different combination of Cu and Ni-alloying. Compositions K and L are containing also high (0.7% and 1.5%) Si-alloying. Composition M contains also high (1.11%) Al-alloying.

TABLE 1

Chemical compositions (in terms of weight percentages)

| | C | Si | Mn | Al | Cr | Ni | Mo | B | V | Nb | Ti | Cu | Ca | P | S | N | H |
|---|---|---|---|---|---|---|---|---|---|---|---|---|---|---|---|---|---|
| A | 0.30 | 0.20 | 0.50 | 0.03 | 0.80 | 2.00 | 0.44 | 0.0002 | 0.010 | 0.002 | 0.005 | 0.01 | 0.002 | 0.01 | 0.0010 | 0.005 | 0.0002 |
| B | 0.29 | 0.22 | 0.50 | 0.04 | 0.80 | 2.01 | 0.50 | 0.0003 | 0.010 | 0.002 | 0.024 | 0.02 | 0.003 | 0.01 | 0.0010 | 0.006 | 0.0002 |
| C | 0.36 | 0.20 | 0.62 | 0.05 | 0.39 | 2.00 | 0.15 | 0.0002 | 0.002 | 0.001 | 0.002 | 0.00 | — | 0.01 | 0.0010 | 0.001 | <0.0001 |
| D | 0.41 | 0.21 | 0.62 | 0.04 | 0.38 | 2.03 | 0.13 | 0.0001 | 0.002 | 0.001 | 0.001 | 0.00 | — | 0.01 | 0.0010 | 0.001 | <0.0001 |
| E | 0.40 | 0.20 | 0.61 | 0.04 | 0.39 | 1.99 | 0.14 | 0.0001 | 0.002 | 0.001 | 0.013 | 0.00 | — | 0.01 | 0.0010 | 0.001 | <0.0001 |
| F | 0.42 | 0.21 | 0.62 | 0.06 | 0.39 | 3.87 | 0.15 | 0.0001 | 0.002 | 0.002 | 0.002 | 0.00 | — | 0.01 | 0.0010 | 0.001 | <0.0001 |
| G | 0.40 | 0.23 | 0.61 | 0.041 | 0.39 | 2.9 | 0.15 | 0.0001 | 0.002 | 0.001 | 0.0016 | 0.99 | — | 0.01 | 0.0010 | 0.001 | <0.0002 |
| H | 0.41 | 0.22 | 0.63 | 0.061 | 0.38 | 1.55 | 0.14 | 0.0001 | 0.002 | 0.001 | 0.0013 | 1.47 | — | 0.01 | 0.0008 | 0.001 | <0.0003 |
| I | 0.41 | 0.21 | 0.62 | 0.047 | 0.39 | 1.5 | 0.15 | 0.0001 | 0.002 | 0.001 | 0.0108 | 1.48 | — | 0.01 | 0.0008 | 0.001 | <0.0004 |
| J | 0.40 | 0.22 | 0.63 | 0.05 | 0.39 | 3.32 | 0.15 | 0.0001 | 0.002 | 0.001 | 0.0013 | 0.5 | — | 0.01 | 0.0013 | 0.001 | <0.0005 |
| K | 0.41 | 0.7 | 0.64 | 0.047 | 0.38 | 3.26 | 0.15 | 0.0001 | 0.002 | 0.001 | 0.0016 | 0.48 | — | 0.01 | 0.0011 | 0.001 | <0.0006 |
| L | 0.41 | 1.5 | 0.62 | 0.056 | 0.39 | 3.3 | 0.15 | 0.0001 | 0.002 | 0.001 | 0.0019 | 0.49 | — | 0.01 | 0.0014 | 0.001 | <0.0007 |
| M | 0.39 | 0.23 | 0.64 | 1.108 | 0.39 | 3.82 | 0.15 | 0.0001 | 0.002 | 0.001 | 0.0019 | 0.49 | — | 0.01 | 0.0016 | 0.001 | <0.0008 |
| N | 0.33 | 0.25 | 0.52 | 0.04 | 0.80 | 2.00 | 0.45 | 0.0003 | 0.010 | 0.002 | 0.005 | 0.01 | 0.002 | 0.01 | 0.0010 | 0.005 | 0.0002 |
| O | 0.31 | 0.21 | 0.51 | 0.04 | 0.80 | 2.00 | 0.45 | 0.0002 | 0.010 | 0.002 | 0.005 | 0.01 | 0.002 | 0.01 | 0.0010 | 0.005 | 0.0002 |

Table 2 shows the parameters used in Examples 1-37 and in a Reference Example REF. The Reference Example REF was obtained by further re-heating and quenching (RHQ) the steel strip produced by the Example 2 to demonstrate the effect of austenite refining and/or deformation immediately prior to quenching on the resulting Brinell hardness (HBW) of a high-hardness hot-rolled steel product. Table 2 shows the process which was used in each example in the column "Process", the final product thickness in the column "Th", the heating temperature in the column "HT" and the quenching finishing temperature in the column "QFT". Also the hot-rolling conditions are shown in the column "Rolling types", in which 1 means Type I hot-rolling in the austenite recrystallization regime and 2 means Type II hot-rolling in the no-recrystallization temperature range but above the ferrite formation temperature $A_{r3}$. RT in the column "QFT" means room temperature.

TABLE 2

| Processes | | | | | | |
|---|---|---|---|---|---|---|
| Example | Steel | Process | Th (mm) | HT (° C.) | Rolling types | QFT (° C.) |
| 1 | A | DQ-Strip | 5.0 | 1280 | 1 + 2 | RT |
| 2 | A | DQ-Strip | 5.9 | 1280 | 1 + 2 | RT |
| 3 | B | DQ-Plate | 10.7 | 1230 | 1 | 160 |
| 4 | A | DQ-Plate | 10.9 | 1230 | 1 | 150 |
| 5 | A | DQ-Plate | 11.1 | 1230 | 1 | 150 |
| 6 | A | DQ-Plate | 11.3 | 1230 | 1 | 150 |
| 7 | A | DQ-Plate | 12.4 | 1230 | 1 | 150 |
| 8 | A | DQ-Plate | 15 | 1230 | 1 | 150 |
| 9 | C | DQ-Lab | 8.0 | 1200 | 1 | 190 |
| 10 | C | DQ-Lab | 8.0 | 1200 | 1 + 2 | 165 |
| 11 | C | DQ-Lab | 8.0 | 1200 | 1 + 2 | 250 |
| 12 | D | DQ-Lab | 8.0 | 1200 | 1 | 160 |
| 13 | D | DQ-Lab | 8.0 | 1200 | 1 + 2 | 165 |
| 14 | D | DQ-Lab | 8.0 | 1200 | 1 | 265 |
| 15 | D | DQ-Lab | 8.0 | 1200 | 1 + 2 | 230 |
| 16 | E | DQ-Lab | 8.0 | 1200 | 1 | 160 |
| 17 | E | DQ-Lab | 8.0 | 1200 | 1 + 2 | 180 |
| 18 | E | DQ-Lab | 8.0 | 1200 | 1 | 270 |
| 19 | E | DQ-Lab | 8.0 | 1200 | 1 + 2 | 255 |
| 20 | F | DQ-Lab | 8.0 | 1200 | 1 | 250 |
| 21 | F | DQ-Lab | 8.0 | 1200 | 1 + 2 | 225 |
| 22 | G | DQ-Lab | 8.0 | 1200 | 1 | 270 |
| 23 | G | DQ-Lab | 8.0 | 1200 | 1 + 2 | 260 |
| 24 | H | DQ-Lab | 8.0 | 1200 | 1 | 140 |
| 25 | H | DQ-Lab | 8.0 | 1200 | 1 + 2 | 165 |
| 26 | H | DQ-Lab | 8.0 | 1200 | 1 | 270 |
| 27 | H | DQ-Lab | 8.0 | 1200 | 1 + 2 | 260 |
| 28 | J | DQ-Lab | 8.0 | 1200 | 1 | 145 |
| 29 | J | DQ-Lab | 8.0 | 1200 | 1 + 2 | 170 |
| 30 | K | DQ-Lab | 8.0 | 1200 | 1 | 260 |
| 31 | K | DQ-Lab | 8.0 | 1200 | 1 + 2 | 250 |
| 32 | L | DQ-Lab | 8.0 | 1200 | 1 | 155 |
| 33 | L | DQ-Lab | 8.0 | 1200 | 1 + 2 | 170 |
| 34 | M | DQ-Lab | 8.0 | 1200 | 1 | 160 |
| 35 | M | DQ-Lab | 8.0 | 1200 | 1 + 2 | 155 |
| 36 | N | DQ-Plate | 10.7 | 1230 | 1 | 150 |
| 37 | O | DQ-Strip | 3.9 | 1280 | 1 + 2 | RT |
| REF | A | RHQ | 5.9 | 900 | — | RT |

Table 3 shows the results of tensile strength and hardness testing, Charpy-V testing, flangeability (i.e. bendability) testing and microstructural characterization of the same.

Table 3 shows, the tensile strength in the column "Rm", the impact toughness at different temperatures under the column "Charpy-V testing", the transition temperature of 20J in the column "T20J", the main microstructural phase in the column "Main phase" in which M means martensitic, the prior austenite grain size in the column "PAG" and the aspect ratio in the column "PAG AR". In addition hardness, minimum bending radius and residual austenite measurements are given. Units of the values are given in parenthesis.

Hardness measurements in Examples 1-8 and 36-37 are taken by the above mentioned testing conditions as an average of three different measurements. As opposed to that, hardness measurements in Examples 9-35 and REF were taken by Vickers hardness measurements according to SFS-EN ISO 6507-1:2006 and converted to Brinell hardness according to ASTM E 140-97. The hardness values in Examples 9-35 are given as average hardness over the thickness of the plates.

TABLE 3

Results of tensile testing, Charpy-V testing, hardness testing, flangeability testing, and microstructure characterization.

| | | | | Charpy-V testing | | | | | | Min. | Microstructure | | | |
|---|---|---|---|---|---|---|---|---|---|---|---|---|---|---|
| | | | | | | | | | | bending | | Residual | | |
| Steel | Hardness (HBW) | Rm (MPa) | A (%) | 60° C. (J/cm2) | 40° C. (J/cm2) | 20° C. (J/cm2) | −20° C. (J/cm2) | −40° C. (J/cm2) | T20J (° C.) | radius (mm) | Main phase | austenite content (%) | PAG (μm) | PAG AR |
| A | 572 | 1942 | 9.2 | | | | | | | | M | | | |
| A | 568 | 1906 | 10 | 167 | | 140 | 107 | 93 | | 3 * Th | M | | 13 | 1.6 |

TABLE 3-continued

Results of tensile testing, Charpy-V testing, hardness testing, flangeability testing, and microstructure characterization.

| | | | | Charpy-V testing | | | | | | Min. bending | Microstructure | | | |
|---|---|---|---|---|---|---|---|---|---|---|---|---|---|---|
| Steel | Hardness (HBW) | Rm (MPa) | A (%) | 60° C. (J/cm2) | 40° C. (J/cm2) | 20° C. (J/cm2) | −20° C. (J/cm2) | −40° C. (J/cm2) | T20J (° C.) | radius (mm) | Main phase | Residual austenite content (%) | PAG (μm) | PAG AR |
| B | 548 | 1881 | 9.7 | 61 | | 51 | 41 | 35 | | 2.7 * Th | M | 1.7 | 16 | 1.2 |
| A | 564 | | | | | | | | | | M | | | |
| A | 546 | | | | | | | | | | M | | | |
| A | 552 | | | | | | | | | | M | | | |
| A | 547 | | | | | | | | | | M | | | |
| A | 555 | | | | | | | | | | M | | | |
| C | 547 | 2089 | 10.3 | | 51 | 65 | | | 10 | | M | 4.1 | 15 | 1.2 |
| C | 579 | 2096 | 10.6 | | 53 | 48 | | | ≤0 | | M | 3.6 | 13 | 3.5 |
| C | 572 | 1980 | 10.5 | | 73 | 63 | | | ≤0 | | M | 6.1 | 13 | 3.4 |
| D | 599 | 2276 | 11 | 27 | 22 | 27 | | | 120 | | M | 5.1 | 16 | 1.2 |
| D | 613 | 2272 | 10.2 | 36 | 41 | 41 | | | 100 | | M | 5.2 | 13 | 2.9 |
| D | 548 | 1931 | 9.8 | 44 | 44 | 29 | | | 110 | | M | 5.6 | 15 | 1.2 |
| D | 606 | 2089 | 11.8 | 53 | 39 | 41 | | | 50 | | M | 6.6 | 14 | 3.0 |
| E | 573 | 2160 | 9.1 | 39 | 32 | 34 | | | 110 | | M | 5.1 | 14 | 1.3 |
| E | 624 | 2235 | 10.3 | 41 | 44 | 41 | | | 100 | | M | 4.0 | 13 | 3.0 |
| E | 565 | 2098 | 10.9 | 51 | 51 | 44 | | | 30 | | M | 6.4 | 15 | 1.3 |
| E | 602 | 2033 | 10.1 | 51 | 46 | 36 | | | 50 | | M | 5.0 | 13 | 2.8 |
| F | 584 | 2041 | 10.3 | 51 | 48 | 44 | | | 40 | | M | 6.8 | 14 | 1.2 |
| F | 607 | 2183 | 12 | 46 | 44 | 39 | | | 70 | | M | 5.4 | 13 | 3.5 |
| G | 585 | 2048 | 10.9 | 39 | | | | 36 | 120 | | M | 6.1 | 13 | 1.2 |
| G | 627 | 2016 | 9.6 | 46 | | | | 39 | 80 | | M | 7.1 | 13 | 3.5 |
| H | 574 | 2008 | 9.1 | 27 | | | | 19 | 120 | | M | 5.5 | 11 | 1.3 |
| H | 673 | 2081 | 10.5 | 41 | | | | 34 | 100 | | M | 4.3 | 14 | 3.0 |
| H | 590 | 1954 | 10.4 | 51 | | | | 27 | 60 | | M | 6.2 | 12 | 1.2 |
| H | 614 | 2014 | 11.4 | 44 | | | | 39 | 80 | | M | 6.1 | 13 | 3.1 |
| J | 626 | 2005 | 8.9 | 34 | | | | 19 | 130 | | M | 6.3 | 11 | 1.2 |
| J | 667 | 1584 | | 39 | | | | 29 | 120 | | M | 5.0 | 14 | 2.8 |
| K | 594 | 1954 | | 44 | | | | 32 | 80 | | M | 6.7 | 13 | 1.2 |
| K | 606 | 2061 | 9.8 | 44 | | | | 39 | 100 | | M | 8.1 | 13 | 2.9 |
| L | 603 | 2153 | 10.2 | 41 | | | | 24 | 110 | | M | 4.8 | 14 | 1.2 |
| L | 637 | 2314 | 9.1 | 36 | | | | 22 | 130 | | M | 5.9 | 12 | 2.8 |
| M | 620 | 1921 | 5.1 | 34 | | | | 0 | 120 | | M | 7.6 | 15 | 1.3 |
| M | 641 | 2115 | 9.9 | 29 | | | | 17 | 120 | | M | 5.5 | 12 | 3.4 |
| N | 591 | 1834 | 8.7 | | | | | | | 3.3 * Th | M | | | |
| O | 566 | 1963 | 9.1 | | | | | 40 | | 3.1 * Th | M | | | |
| A | 540 | | | | | | | | | | M | | 10 | 1.1 |

As can be seen, all the Examples 1-37 provide higher hardness, in terms of HBW, than the Reference Example REF (540 HBW). This is valid despite of the fact that in Example 3 composition B including a lower carbon content than composition A of Reference Example REF was used. This is actually somewhat against common theory of the relation between carbon content and martensite hardness. Thereby the Examples clearly show hardness improvement and that lowering of carbon content of high hardness Ni-alloyed steels is enabled by the present invention.

It can also be seen that if the hot rolling step comprises type I and type II hot-rolling stages each and every example provided a Brinell hardness of 550 HBW or higher.

Also it can be seen that the Examples are able to provide a tensile strength of higher than 1500 MPa or even higher than 1800 MPa. Total elongations (A) were predominantly at least 8%. Moreover the combination of Rm>1800 MPa and A>=8% was predominantly satisfied.

Also it can be seen that the Example 2, which comprised Type II hot-rolling stage in addition to Type I hot-rolling in the hot-rolling step, is able to provide a high-hardness hot-rolled steel product with impact toughness more than 100 J/cm$^2$ at a temperature of −20° C. or higher, measured by Charpy-V testing.

Also it can be seen that the Examples are able to provide a high-hardness hot-rolled steel product that can be flanged with a tight bending radius. High hardness hot-rolled steel having thickness Th of 2-15 mm can be flanged to minimum bending radius of 3.3*Th (mm), preferably even 3.0*Th (mm) without visually noticeable cracks or fractures in the bend when the bending angle is equal or higher than 90° and when the lower tool of bending is having a V-gap with a maximum width of 100 mm. A tight bending radius means improved designs in applications made of this steel. In other words, the bendability of the steel is excellent taking into account high hardness.

Next Examples 1-37 are described in more detail.

In the full scale Examples 1-8 and 36-37 shown in Table 2 and 3, steel slabs having the chemical compositions A,B, N and O were used. Both steel plates (DQ-Plate) and steel strips (DQ-Strip) were produced of these slabs as can be seen from Table 2. In these Examples 1-8 and 36-37, the steel slabs for producing steel strips and plates were austenitized by heating to a heating temperature (HT) of 1280° C. and 1230° C., respectively. The heating step was followed by an equalizing step for about 1 hour.

In Examples 1, 2 and 37 subsequent to the equalizing step the hot-rolling process was initiated with a rough rolling step followed by a strip rolling step in which different final strip thicknesses of 5.0 mm, 5.9 mm and 3.9 mm were rolled. Between the rough rolling step and strip rolling step the coil box was used as usual. After the final rolling pass, direct quenching to a quenching finishing temperature (QFT) was performed. Steel strips were directly quenched from the hot-rolling heat to room temperature (RT) by using an average cooling rate of 50 ° C./s. As can be seen, the hardness values of direct quenched steel strips are clearly higher than that of the Reference Example REF.

Examples 1, 2 and 37 comprised Type II hot-rolling stage in addition to Type I hot-rolling stage in the hot-rolling step. Type II hot-rolling results in elongated austenite grains, that can be seen in the aspect ratio (PAG AR), that is higher than 1.3, measured from prior austenite grain structure of Example 2. As can be seen, in addition to high hardness, Example 2 holds excellent properties in Charpy-V testing partly due to the elongated prior austenite grains.

Example 3 in which composition B was used shows the harmful effect of 0.024% Ti-alloying on Charpy-V impact toughness. As can be seen, the impact toughness properties are multifold when Ti is less than 0.02%. The reason might be coarse TiN particles which are harmful for impact toughness property of this type of steel. Therefore, if also excellent impact toughness values are also desired, Ti is preferably less than 0.02% or more preferably less than 0.01%.

In Examples 3-8 and 36, subsequent to the equalizing step, the hot-rolling process was performed by using several rolling passes at a plate-rolling mill to achieve the desired thickness. The hot-rolling consisted of Type I hot-rolling, i.e. hot-rolling did not comprise Type II hot-rolling. After the final rolling pass, the direct quenching to a quenching finishing temperature (QFT) was performed. Steel plates were directly quenched from the hot-rolling heat to a temperature of 160° C. or 150° C. by using an average cooling rate of 150° C./s. As can be seen, the hardness values of direct quenched steel plates are clearly higher than the same of the Reference Example REF. In other words, substantial elongation of prior austenite grains during hot-rolling is not necessarily needed to obtain a hardness improvement as compared to a conventional RHQ process. However, elongation of prior austenite grains further improves the hardness as also shown.

In Examples 1-8 and 36-37, values of tensile strength testing, Charpy-V testing and flangeability testing are given as an average calculated from specific values in longitudinal and transversal directions (in respect to rolling direction).

In the laboratory Examples 9-35, steel billets (simulating steel slabs) having the chemical composition C, D, E, F, G, H, I, J, K, L and M shown in Table 1 were used. In these experiments 50 mm thick steel billets were austenitized by heating to a temperature of 1200° C. and equalized for two hours. Subsequent to the equalizing step the hot-rolling process was performed by using several rolling passes at a laboratory rolling mill to achieve the desired thickness of 8 mm. The content of hot-rolling step was varied according to Table 2. After the final rolling pass, direct quenching to a quenching finishing temperature (QFT) was performed. Steel plates were directly quenched from the hot-rolling heat to a temperature of roughly 150° C. or 250° C. by using an average cooling rate in the range 60-100° C./s.

In Examples 9-35, the values of tensile strength testing, Charpy-V testing and the transition temperatures are given in longitudinal direction with respect to the rolling direction due to the specimen sizes in laboratory environment.

As can be seen, the hardness values of direct quenched steel plates and strips are clearly higher than the same of the Reference Example REF.

As can be also seen by comparing the Examples 9-11 (composition C) and Examples 12-15 (composition D), the impact toughness is improved significantly with composition C including a lower carbon content. Therefore, in order to ensure impact toughness properties, it is preferred that the carbon content is less than or equal to 0.36%. However it must be noted that in a full scale environment all impact toughness properties are better due to the higher rolling reductions in industrial scale.

Also transition temperatures of 20J are given in Table 3 (measured by Charpy-V specimen size 7.5 mm, notch size 2 mm). This corresponds with transition temperature of about 34 J/cm$^2$.

As can be also seen, each laboratory example that comprised only type I hot-rolling results in that measurements related to aspect ratio (PAG AR) were giving values less than or equal to 1.3. This means that in these Examples 9, 12, 14, 16, 18, 20, 22, 24, 26, 28, 30, 32 and 34 prior austenite grain structure was not substantially elongated in the meaning of this description.

However, each laboratory example that comprised also Type II hot-rolling provided an aspect ratio (PAG AR) higher than 1.3 or even higher than 2.0, as can be seen from these Examples 10, 11, 13, 15, 17, 19, 21, 23, 25, 27, 29, 31, 33 and 35. Especially all satisfy PAG AR>2.0. Further such limit value of 2.0 represents the elongated prior austenite grain structure very well, because it reflects the limit when the lengths of the grains are more than twice as long compared to their heights. Such feature can be clearly distinguished from substantially equiaxial prior austenite grain structure and cannot be obtained by RHQ process.

Figure 3:
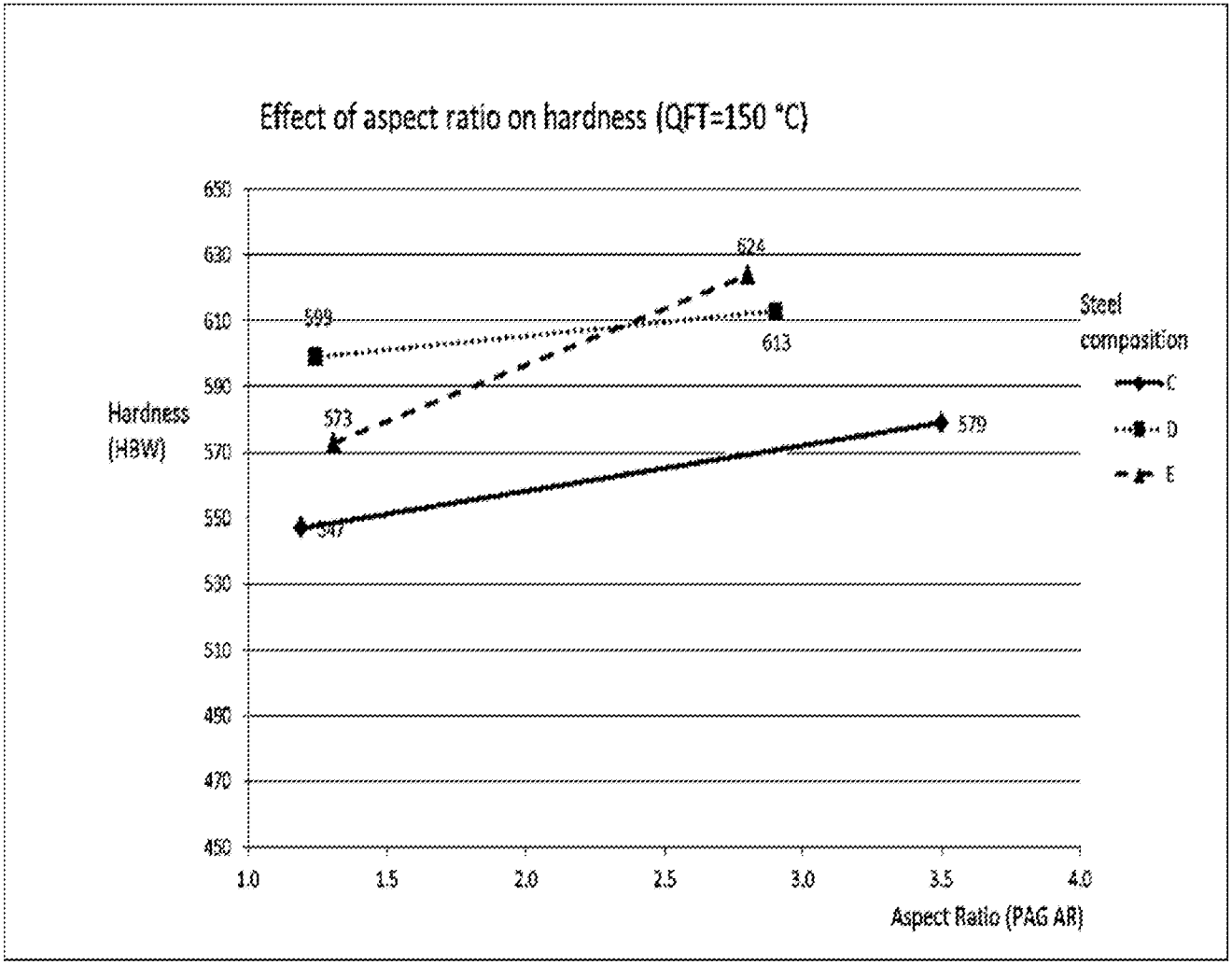
FIGS. 3 and 4 are graphs showing the effect of the present invention based on few examples described more detailed in the following.
Figure 4:
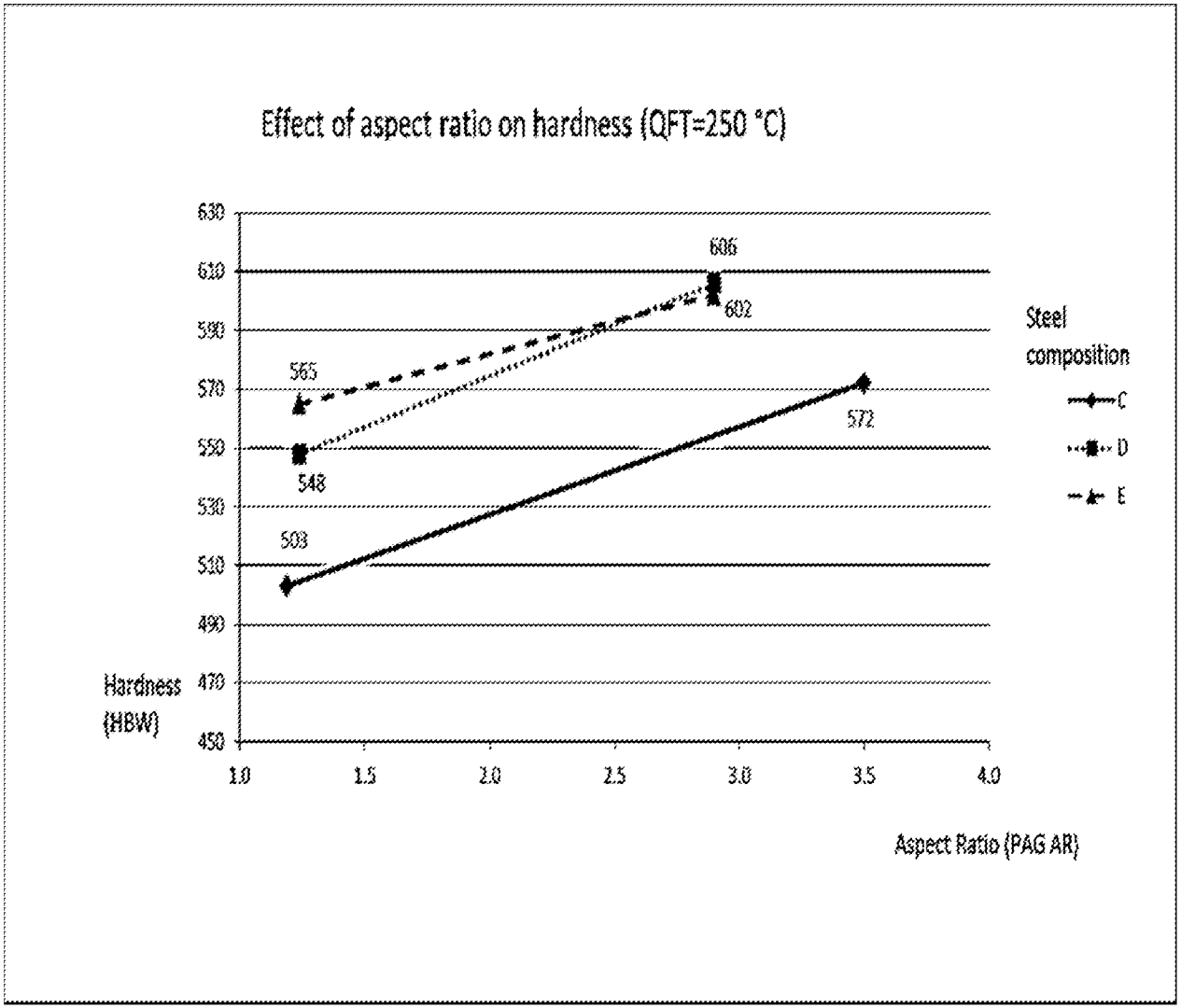

The increase of the aspect ratio measured from prior austenite grain structure of the Examples 9-35 clearly shows that if the aspect ratio is higher than 1.3, a further higher hardness, in terms of Brinell hardness, will follow. The higher the aspect ratio value, the higher the Brinell hardness. This is also shown graphically in FIGS. 3 and 4 with different quenching finishing temperatures of about 150° C. and 250° C.

It will be obvious to a person skilled in the art that, as the technology advances, the inventive concept can be implemented in various ways. The invention and its embodiments are not limited to the Examples described above but may vary within the scope of the claims.

The invention claimed is:

1. A hot-rolled steel product having an elongated prior austenite grain structure, the hot rolled steel product consisting of: 0.25-0.45 wt % of carbon, 0.01-1.5 wt % of silicon, more than 0.35 wt % and no more than 3.0 wt % of manganese, more than 0.5 wt % and no more than 4.0 wt % of nickel, 0.01-1.2 wt % of aluminum, less than 2.0 wt % of chromium, less than 1.0 wt % of molybdenum, less than 1.5 wt % of copper, less than 0.5 wt % of vanadium, less than 0.2 wt % of niobium, less than 0.2 wt % of titanium, less than 0.0005 wt % of boron, less than 0.01 wt % of calcium, with the balance being iron, residual contents, and unavoidable impurities; wherein the microstructure of the steel product is martensitic, wherein the steel product has a Brinell hardness of at least 540 HBW, a tensile strength of higher than 1500 MPa, and wherein the aspect ratio of the elongated prior austenite grain structure is greater than or equal to 1.2.

2. The hot-rolled steel product according to claim 1, wherein the aspect ratio of the elongated prior austenite grain structure of the steel product is greater than 1.3.

3. The hot-rolled steel product according to claim 1, wherein the weight percent of carbon is 0.28-0.4 wt %.

4. The hot-rolled steel product according to claim 1, wherein the weight percent of nickel is 1.5-2.5 wt %.

5. The hot-rolled steel product according to claim 1, wherein the weight percent of molybdenum is 0.1-1.0 wt %.

6. The hot-rolled steel product according to claim 1, wherein the hot-rolled steel product is a hot-rolled steel plate having a thickness of 8-80 mm.

7. The hot-rolled steel product according to claim 1, wherein the microstructure comprises at least 90% by volume of martensite; or wherein the microstructure comprises 60-95% by volume of martensite, 10-30% by volume of bainite, 0-10% by volume of austenite, and 0-5% by volume of ferrite.

8. The hot-rolled steel product according to claim 1, wherein the hot rolled steel product is a hot-rolled steel strip having a thickness of 2-15 mm.

9. The hot-rolled steel product according to claim 1, wherein the hot rolled steel product contains less than 0.0003 wt % boron.

10. The hot-rolled steel product according to claim 1, wherein the hot rolled steel product has a Brinell hardness of at least 550 HBW.

11. The hot-rolled steel product according to claim 1, wherein the hot rolled steel product has a Brinell hardness from 547 to 673 HBW.

12. A method of manufacturing a hot-rolled steel product according to claim 1 having a Brinell hardness of at least 540 HBW, a tensile strength of higher than 1500 MPa, the method comprising in order: a) providing a steel slab consisting of 0.25-0.45 wt % of carbon, 0.01-1.5% wt % of silicon, more than 0.35 wt % and no more than 3.0 wt % of manganese, more than 0.5 wt % and no more than 4.0 wt % of nickel, 0.01-1.2 wt % of aluminum, less than 2.0 wt % of chromium, less than 1.0 wt % of molybdenum, less than 1.5 wt % of copper, less than 0.5 wt % of vanadium, less than 0.2 wt % of niobium, less than 0.2 wt % of titanium, less than 0.0005 wt % of boron, less than 0.01 wt % of calcium, and a balance of iron, residual contents, and unavoidable impurities; b) heating the steel slab to a temperature in the range 950° C.-1350° C.) subjecting the slab to a temperature equalizing step; d) subjecting the slab to a hot-rolling step in a temperature range of $A_{r3}$ to 1300° C. to obtain a hot-rolled steel material, and e) direct quenching the hot-rolled steel material to a temperature of less than $M_s$.

13. The method of claim 12, wherein the hot rolling step comprises a Type I hot-rolling stage in the recrystallization temperature range.

14. The method of claim 13, wherein the hot-rolling step further comprises a Type II hot-rolling stage of hot-rolling in the no-recrystallization temperature range but above $A_{r3}$.

15. The method of claim 12, wherein the direct quenching comprises quenching the hot-rolled steel material from a temperature higher than $A_r$ to a temperature $T_{QFT2}$ between the temperature of less than $M_s$ and 100° C. using an average cooling rate of 10-200° C./s.

16. The method of claim 12, wherein the direct quenching step comprises quenching the hot-rolled steel material from a temperature higher than $A_r$ to a temperature $T_{QFT1}$ less than 100° C. using an average cooling rate of 10-200° C./s.

17. The method of claim 12, wherein the steel slab consists of 0.28-0.4 wt % of carbon.

18. The method of claim 12, wherein the steel slab consists of 1.5-2.5 wt % of nickel.

19. The method of claim 12, wherein the steel slab consists of 0.1-1.0 wt % of molybdenum.

* * * * *